US007108019B2

(12) United States Patent
Nagura et al.

(10) Patent No.: US 7,108,019 B2
(45) Date of Patent: Sep. 19, 2006

(54) INDUSTRIAL TWO-LAYER FABRIC

(75) Inventors: Hiroyuki Nagura, Shizuoka (JP); Ikuo Ueda, Shizuoka (JP); Shigenobu Fujisawa, Shizuoka (JP)

(73) Assignee: Nippon Filcon Co., Tokyo (JP)

( * ) Notice: Subject to any disclaimer, the term of this patent is extended or adjusted under 35 U.S.C. 154(b) by 239 days.

(21) Appl. No.: 10/443,061

(22) Filed: May 22, 2003

(65) Prior Publication Data

US 2003/0217782 A1 Nov. 27, 2003

(30) Foreign Application Priority Data

May 24, 2002 (JP) ..... 2002-150216
Jul. 5, 2002 (JP) ..... 2002-197018
Jul. 5, 2002 (JP) ..... 2002-197058
Aug. 1, 2002 (JP) ..... 2002-224817

(51) Int. Cl.
*D03D 11/00* (2006.01)

(52) U.S. Cl. ..... 139/383 A; 162/358.2; 162/900; 162/902

(58) Field of Classification Search ..... 139/383 A; 162/358.2, 900, 902
See application file for complete search history.

(56) References Cited

U.S. PATENT DOCUMENTS 4,998,568 A 3/1991 Vöhringer
5,152,326 A 10/1992 Vöhringer
5,421,374 A * 6/1995 Wright ..... 139/383 A
5,555,917 A * 9/1996 Quigley ..... 139/383 A
5,564,475 A * 10/1996 Wright ..... 139/383 A
5,709,250 A * 1/1998 Ward et al. ..... 139/383 A
5,826,627 A * 10/1998 Seabrook et al. ..... 139/383 A
5,857,498 A * 1/1999 Barreto et al. ..... 139/383 A
5,865,219 A * 2/1999 Lee et al. ..... 139/383 A
6,267,150 B1 * 7/2001 Herring ..... 139/383 AA
6,273,147 B1 * 8/2001 Herring ..... 139/383 AA
6,318,413 B1 * 11/2001 Herring ..... 139/383 AA
6,349,749 B1 * 2/2002 Quigley ..... 162/902

FOREIGN PATENT DOCUMENTS

EP 0 889 160 A1 7/1997

* cited by examiner

*Primary Examiner*—John J. Calvert
*Assistant Examiner*—Robert H. Muromoto
(74) *Attorney, Agent, or Firm*—Rader, Fishman & Grauer PLLC

(57) ABSTRACT

An industrial two-layer fabric comprises an upper layer fabric having upper surface side warps and upper surface side wefts and a lower layer fabric having lower surface side warps and lower surface side wefts. The upper layer fabric and the lower layer fabric are bound at least one spot in a repeating unit where an upper surface side warp weaves a lower surface side weft without weaving an upper surface side weft which should have been woven by the upper surface side warp based on the fabric structure, and where a lower surface side warp weaves the upper surface side weft which should have been woven by the upper surface side warp, without weaving the lower surface side weft which should have been woven by the lower surface side warp.

13 Claims, 14 Drawing Sheets

PRIOR ART

PRIOR ART

INDUSTRIAL TWO-LAYER FABRIC

TECHNICAL FIELD OF THE INVENTION

The present invention relates to industrial fabrics such as a papermaker's forming fabric, a fabric for producing a nonwoven fabric, a fabric used to remove or squeeze water out of sludge and the like, a belt for producing construction materials, and a conveyor belt. In particular, the present invention relates to a papermaker's fabric, particularly a fabric for producing tissues.

DESCRIPTION OF RELATED ART

Industrial fabrics which have been conventionally used include papermaker's fabrics such as a papermaker's forming fabric and a canvas, a fabric for producing a nonwoven fabric, a fabric used to remove or squeeze water out of sludge and the like, a belt for producing construction materials, a conveyor belt, and the like. These industrial fabrics run under tension in a longitudinal direction at the time of use. Hence, they must have dimensional stability so as to prevent contraction in a width direction and elongation from occurring. Further, they must also have postural stability so as to prevent meandering and wrinkling from occurring. In addition, they must also have wear resistance since they are abraded by contacting driving rollers or the like while running. Furthermore, they must have a smooth surface since materials to be carried or processed are placed thereon.

Such problems are more or less common problems among industrial fabrics and are not yet solved even at present. Of the industrial fabrics, a papermaker's fabric which is most strictly required to have these properties, particularly a papermaker's forming fabric, is required to have properties peculiar to papermaking in addition to the above properties. The peculiar properties will be described later. Since most of problems common to the industrial fabrics and solutions thereof can be understood by describing the papermaker's forming fabric, the present invention will be described hereinafter by use of the papermaker's forming fabric as a representative example.

A papermaking process is a known technique. Firstly, raw materials for papermaking including pulp fibers and the like are fed onto a papermaker's forming fabric which is formed endlessly from a headbox and running between rollers of a paper machine. A side of the papermaker's forming fabric where the raw materials are fed is an upper surface side, and the other side is a lower surface side.

The fed raw materials move along with running of the papermaker's forming fabric. While the materials are moving, water is removed therefrom by centrifugal force or dewatering equipment such as a suction box or foil disposed on the lower surface side of the fabric so as to form a wet web. That is, the papermaker's forming fabric serves as a filter so as to separate water from the pulp fibers.

The wet web formed in this papermaking zone is then transferred to a press zone and then to a dryer zone. In the press zone, the wet web is transferred by papermaker's forming felt and further dewatered together with the felt by a nip pressure between press rollers. In the dryer zone, the wet web is carried by a papermaker's forming canvas and dried, whereby paper is produced.

A papermaker's fabric is woven by a weaving machine by use of warps and wefts composed of, e.g., synthetic resin monofilaments. It can be formed endlessly by a known seam, pin seam or the like or by a hollow weaving machine in a weaving step. In the case of hollow weaving, the relationship between warps and weaves is reversed between weaving of the fabric and actual use of the fabric.

In the present specification, warps are yarns extending in a machine direction of a papermaking machine, i.e., in a direction in which the fabric is headed, and wefts are yarns extending in a machine crossing direction of the papermaking machine, i.e., in a width direction of the fabric.

Meanwhile, to improve the supportability of the fibers effectively and to produce paper of good quality without having wire marks on the paper, it is important that the fibers are suitably supported by the wefts in view of the orientation of the fibers and the like. In particular, in the case of a papermaker's forming fabric for producing tissues, since the tissue is very thin paper and since a dewatering zone is short in spite of the high speed of a paper machine, fiber supportability and paper removability are particularly required. Poor fiber supportability and paper removability lead to the occurrence of pin holes and cause degradation in opacity and deterioration in paper strength in addition to apparent problems. They also lead to a fiber carryback and a splash and become serious problems from the viewpoint of operation.

Accordingly, as a papermaker's fabric for producing tissues, a single-layer fabric of the type in which primarily wefts form long crimps on the upper surface side has been heretofore used. This is because a tissue machine mostly contains no filler or a trace amount of filler and fiber supportability and paper removability are considered more important than abrasion resistance. However, the single-layer fabric has been becoming unable to keep up with an increasing mechanical load of a papermaking machine which has been increasingly faster. Although the single-layer fabric has such advantages as a small thickness and good freeness, disadvantages caused by insufficient rigidity caused by its structure, such as poor formation, poor transportability and poor retention, have been becoming significantly noticeable.

Under the circumstances, recently, use of a multilayer fabric has been increasing even in the tissue machine and has achieved some degree of success. The multilayer fabric may be a weft double fabric or a two-layer fabric in which an upper layer fabric and a lower layer fabric are bonded to each other by use of binding yarns, and the upper layer fabric has a structure that wefts form long crimps in the upper layer fabric. Further, for the two-layer fabric, for the purpose of making its thickness small so as to secure good dewaterbility and low water retainability, a ribbed plain structure that two warps are placed parallel to each other is primarily used as the structure of the lower layer fabric.

Further, recently, a two-layer fabric of ground yarn binding type such as one disclosed in EP0889160A1 in which an upper layer fabric and a lower layer fabric are bound to each other by use of some upper surface side warps and which has no independent binding yarns is used in some applications. This type of two-layer fabric has no independent binding yarns, so that the number of wefts can be increased with no degradation in freeness (air permeability).

SUMMARY OF THE INVENTION

It has started to be used with the expectation that it could improve fiber supportability. However, it has a significant problem ascribable to the binding portions of the upper surface side warps. That is, since the upper surface side warps serve as binding yarns, no warps are present in the upper layer fabric at the sites where the upper surface side warps go down to the lower surface side, so that local excessive dewatering occurs at the sites, fiber carrybacks, splashes and the like occur, and the sites appear as wire marks. When marks in a lateral direction are remarkable, they even cause an adverse effect at the time of creping. These problems are not yet solved.

In view of the above problems, the present invention provides an industrial two-layer fabric of ground yarn binding type which has no independent binding yarns and has a structure that no absence of warps at binding sites in the upper layer fabric occurs and no local excessive dewatering therefore occurs, whose wefts can be increased in number with no degradation in freeness (air permeability), and which has good fiber supportability, is free from fiber carrybacks, splashes and the like and also has good wire mark properties.

The present invention relates to an industrial two-layer fabric having an upper layer fabric and lower layer fabric. The upper layer fabric comprises upper surface side warps and upper surface side wefts. The lower layer fabric comprises lower surface side warps and lower surface side wefts. The upper layer fabric and the lower layer fabric, having a repeating unit, are bound to each other. At one or more spots or places in the repeating unit, an upper surface side warp serving as a binding yarn goes down to the lower layer fabric, without weaving an upper surface side weft which should have been woven by the upper surface side warp based on fabric structure, once or more times in succession, so as to weave a lower surface side weft once or more times and then goes up to the upper layer fabric so as to weave an upper surface side weft. At the site where the upper surface side warp weaves the lower surface side weft or wefts, a lower surface side warp serving as a binding yarn weaves the upper surface side weft which should have been woven by the upper surface side warp, without weaving the lower surface side weft which should have been woven by the lower surface side warp. In this structure, the upper and lower surface side warps serving as binding yarns may have different weaving structures. Alternatively, the upper and lower surface side warps serving as binding yarns may have the same weaving structure.

The present invention also relates to an industrial two-layer fabric, which comprises an upper layer fabric and a lower layer fabric. The upper layer fabric and the lower layer fabric are bound to each other at a site where a first warp, one of the lower surface side warp and the upper surface side warp, passes between the upper and lower layer fabrics without weaving the weft which should have been woven by the first warp from the viewpoint of the structure of the fabric, and the first warp passes between the upper and lower layer fabrics, a second warp, the other one of the lower surface side warp and the upper surface side warp, weaves the weft which should have been woven by the first warp and serves as a binding yarn.

DESCRIPTION OF THE DRAWINGS

The present inventions will now be described by way of example with reference to the following figures in which.

DETAILED DESCRIPTION OF THE INVENTION

Figure 1:
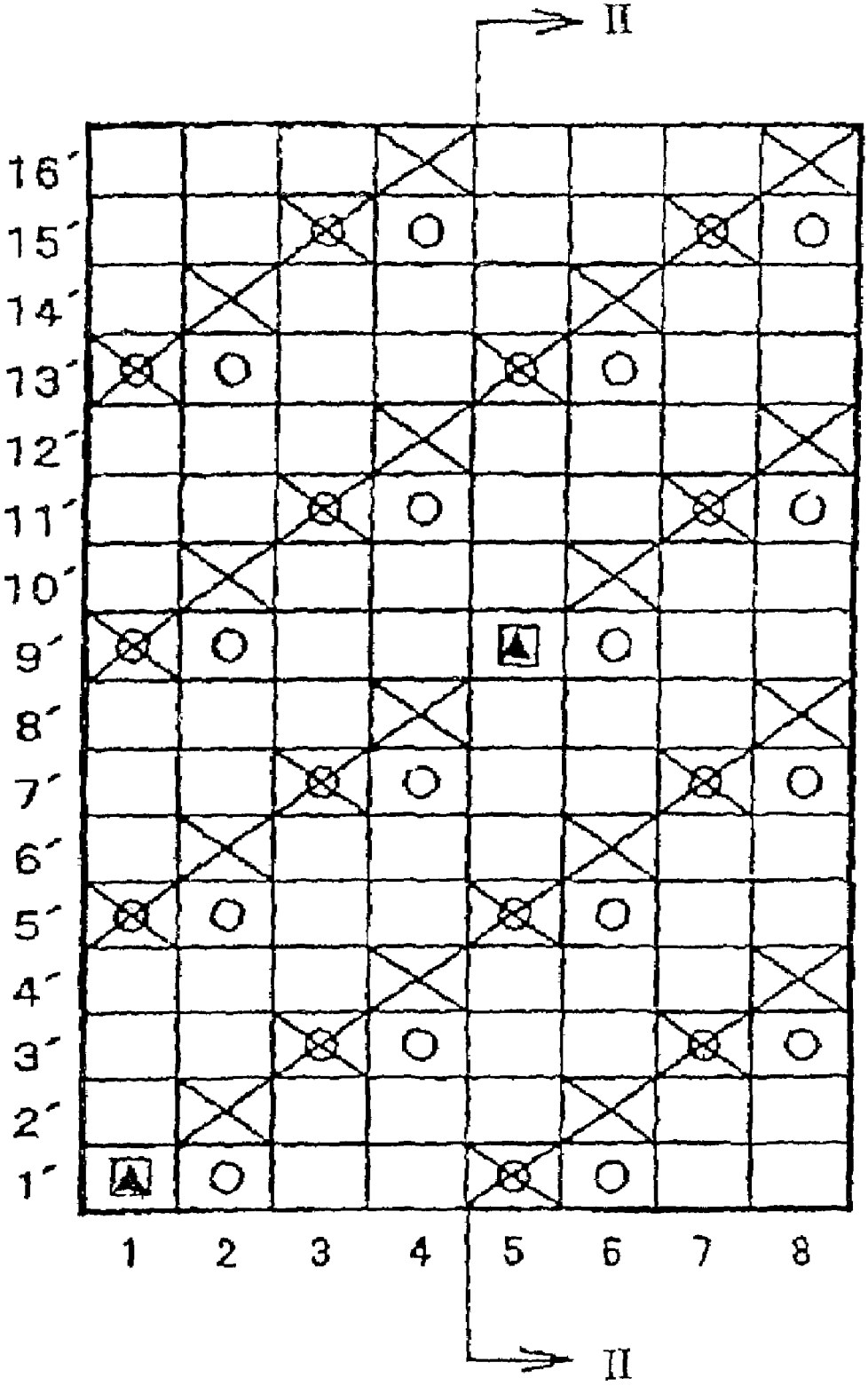
FIG. 1 is a diagram illustrating a repeating unit of Example 1 of the present invention.

Characteristics of the present invention are that two layers are bound together by either or both of upper surface side warps and lower surface side warps, that the binding portions are caused to serve as ground yarns forming the surfaces of the fabrics so as to prevent the structures of the surfaces from becoming out of shape and that the upper surface side warps and the lower surface, side warps are placed in combination, whereby no absence of the warps at the binding sites on the upper surface side occurs and local excessive dewatering does not occur accordingly.

One specific structure of the present invention is that some or all of upper surface side warps, in some portions in a longitudinal direction, go down to the lower surface side without weaving upper surface side wefts which should have been woven by the upper surface side warps from the upper surface side from the viewpoint of the structure of the upper layer fabric once or two or more times and then weave lower surface side wefts which should have been woven by lower surface side warps from the viewpoint of the structure of the lower layer fabric from the lower surface side, and in the portions where the upper surface side warps go down to the lower surface side and weave the lower surface side wefts from the lower surface side, the lower surface side warps go up to the upper surface side without weaving the lower surface side wefts which should have been woven by the lower surface side warps from the lower surface side from the viewpoint of the structure of the lower layer fabric once or two or more times and then weave the upper surface side wefts which should have been woven by the upper surface side warps from the viewpoint of the structure of the upper layer fabric from the upper surface side. Another specific structure of the present invention is that at sites where some or all of upper surface side warps weave upper surface side wefts at one or more spots or places in the repeating unit from the upper surface side or at sites where lower surface side warps weave lower surface side wefts at one or more spots in the repeating unit from the lower surface side, one of the upper surface side warp and the lower surface side warp passes between the upper and lower layer fabrics without weaving the weft which should have been woven by the one warp from the viewpoint of the structure of the fabric, and at the site where the one warp passes between the upper and lower layer fabrics, the other warp weaves the weft which should have been woven by the one warp and serves as a binding yarn. Thus, when some of upper surface side warps and lower surface side warps serve not only as binding yarns but also as ground yarns forming the surfaces of the fabrics, the structures of the fabric surface do not become out of shape, and the absence of warps at the binding sites on the upper surface side never occurs.

With the above constitution of the present invention, in a portion where an upper surface side warp serving as a binding yarn is put under the lower layer fabric, i.e., in a portion of the conventional papermaker's fabric disclosed in EP0889160A1 where the absence of a warp occurs on the upper surface side and leads to local excessive dewatering which then causes problems such as a fiber carryback and a splash, the problem of local excessive dewatering can be solved by causing a lower surface side warp to go up to the upper layer fabric and supports the structure of the upper layer fabric in place of the upper surface side warp or by causing a warp to lie between the upper layer fabric and the lower layer fabric. In the present specification, there are a case where a warp is placed on the surface of the upper layer fabric at a binding site and a case where a warp is placed between upper surface side wefts and lower surface side wefts. Both of these cases are each defined as a "case where a warp is present on the upper surface side".

On the lower surface side as well, in a portion where a lower surface side warp is absent because the warp goes up to the upper surface side so as to support the upper layer fabric, an upper surface side warp goes down to the lower surface side so as to support the lower layer fabric. That is, the upper surface side warp and the lower surface side warp complement each other so as to prevent the occurrence of a portion where no warp is present on the upper surface side.

Since the upper surface side warp weaves a lower surface side weft which should have been woven by the lower surface side warp and the lower surface side warp weaves an upper surface side weft which should have been woven by the upper surface side warp, the structures of the upper and lower layer fabrics substantially do not become out of shape, and good wire mark properties are obtained. Further, even in the case where the warp passes between upper and lower surface side wefts, fiber supportability is secured, so that the problem of excessive dewatering can be solved.

Further, since yarns serving as binding yarns in the present invention are ground yarns constituting the structure of the fabric and are warps which constantly under tension at the time of use, they exhibit a very strong binding force for binding the upper layer fabric and the lower layer fabric to each other as compared with when thin weft binding yarns are used, and the binding force is constantly in effect, so that adhesion between the upper and lower layer fabrics is good. Thus, there occurs no such a problem that internal wear caused by kneading of the biding yarns between the fabrics causes degradation in the binding force which then creates a gap between the fabrics or separates the fabrics. Further, in the present invention, in the case of a structure that the fabrics are bound to each other by both upper and lower ground warps, adhesion between the fabrics further improves.

All warps forming the surface of the upper layer fabric may be used as binding yarns. The ratio of the binding warps to non-binding warps can be changed as appropriate to, for example, 1:1, 1:2, 1:3, 2:1 or 3:1. The binding force can be improved by increasing the number of binding yarns to be provided. Alternatively, as the structure of the warp, the number of bindings in the repeating unit may be once or more.

Further, the structures of the upper and lower layer fabrics are not particularly limited as long as they are structures capable of forming the above constitution. However, when the structure of the upper layer fabric comprises a repetition of a structure that an upper surface side warp passes under three adjacent upper surface side wefts and then passes over an upper surface side weft and a repetition of a structure that an upper surface side weft passes over three adjacent upper surface side warps so as to form a long crimp in the upper layer fabric and then passes under an upper surface side warp, many wefts appear on the surface of the upper layer fabric which is a papermaking surface side, and good fiber supportability can be attained. Further, when the structure of the lower layer fabric is a ribbed plain structure that two lower surface side warps of the same structure are placed parallel to each other, the same state as that when thin flat yarns are used as warps is achieved, and the crimp length of the weft becomes short, so that the thickness of the fabric can be made small. The ribbed plain weave structure is particularly suitable for a papermaker's forming fabric for producing tissues which is particularly required to have good fiber supportability, paper removability and a thin fabric thickness.

The density of the yarns of the lower layer fabric with respect to the upper layer fabric is not particularly limited and may be the same as or ½ or ⅓ of the density of the yarns of the upper layer fabric.

Threads used in the present invention can be selected freely according to the desired properties of an Industrial fabric and are not particularly limited. For example, in addition to monofilaments, multifilaments, spun yarns, processed yarns which are generally referred to as textured yarns, bulky yarns and stretched yarns subjected to crimping, bulking or other processes, chenille yarns, strands of these threads or the like can be used. As for the shapes of the cross sections of the threads, threads having a circular cross section, a rectangular cross section, a brachymorphic cross section such as a star-shaped cross section and an oval cross section or hollow threads can be used. The materials of the threads can be selected freely, and a polyester, nylon, polyphenylene sulfide, polyvinylidene fluoride, tetraethylene fluoride, polypropylene, aramid, polyether ether ketone, polyethylene naphthalate, polytetrafluoroethylene, cotton, wool, metal and the like can be used. As a matter of course, threads obtained by blending various materials into copolymers or these materials according to purposes may also be used.

In general, polyester monofilaments having rigidity and excellent dimensional stability are preferably used as upper and lower surface side warps and upper surface side wefts. Meanwhile, for lower surface side wefts required to have abrasion resistance, by placing a polyester monofilament and a nylon monofilament alternately, abrasion resistance can be improved with rigidity being secured.

Further, a plurality of yarns of the same structure can be placed parallel to one another in a portion where a single yarn should be placed from the viewpoint of the structure of the fabric. By placing a plurality of yarns having a small diameter parallel to one another, surface properties can be improved, and the thickness of the fabric can be made small.

Examples of the present invention will be described with reference to the drawings.

FIG. 1 is a diagram illustrating a repeating unit of an example of the present invention. The repeating unit is a minimum repeating unit of a fabric structure. The repeating units are connected to one another vertically and horizontally so as to form the whole of the fabric structure. In the design drawings, warps are represented by arabic numerals, e.g., 1, 2 and 3, while wefts are represented by arabic numerals with dashes, e.g., 1', 2' and 3'.

Further, a mark "X" indicates that an upper surface side warp lies over an upper surface side weft; a mark "○" indicates that a lower surface side warp lies under a lower surface side weft; a mark "▲" indicates a portion where a lower surface side warp lies over an upper surface side weft, i.e., a binding portion where the lower surface side warp serves as a binding yarn; and a mark "□" indicates a portion where an upper surface side warp lies under a lower surface side weft, i.e., a binding portion where the upper surface side warp serves as a binding yarn.

Upper surface side warps and wefts overlay lower surface side warps and wefts. In the design drawings, the lower surface side warps and wefts lie directly underneath the upper surface side warps and wefts, respectively. This is for the convenience of the drawings, and in an actual fabric, the lower surface side warps and wefts may biasedly lie under the upper surface side warps and wefts. In the present example, a lower layer fabric has a ribbed plain structure in which two adjacent warps have the same structure. Hence, in reality, two lower surface side warps are placed adjacently to each other.

EXAMPLE 1

FIG. 1 is a diagram illustrating a repeating unit of Example 1 of the present invention.

In FIG. 1, reference numerals 1, 2, 3, 4, 5, 6, 7 and 8 represent warps, and upper surface side warps lie over lower surface side warps. Meanwhile, reference numerals 1', 2', 3', . . . 16' represent wefts, and lower surface side wefts are disposed under upper surface side wefts represented by odd numbers, i.e., 1', 3', 5', . . . 15' at a half density of that of the upper surface side wefts.

First, in examining an upper layer fabric, for example, an upper surface side weft 4' passes over three adjacent upper surface side warps 1, 2 and 3, then passes under an upper surface side warp 4, then passes over three adjacent upper surface side warps 5, 6 and 7, and then passes under an upper surface side warp 8. In short, it is understood that the upper layer fabric has a structure that the upper surface side weft 4' passes over the three successive upper surface side warps, and then passes under the one upper surface side warp.

Meanwhile, an upper surface side warp 4 passes under three upper surface side wefts 1', 2' and 3', then passes over an upper surface side weft 4', then passes under three upper surface side wefts 5', 6' and 7', and then passes over an upper surface side weft 8'. In short, it is understood that the fabric has a ⅓ structure that the upper surface side warp passes under the three successive upper surface side wefts, and then passes over the one upper surface side weft. Since upper surface side wefts each form long crimps each corresponding to three upper surface side warps on the surface of the upper layer fabric, the fiber supportability of the wefts becomes good. It is understood that upper surface side warps are in turn shifted upward for a distance equal to the width of an upper surface side weft so as to form a twilled structure. Although the present example adopts the above structure, it is needless to say that it is not limited to the structure and may use a satin woven structure or a structure with longer or shorter weft crimps. When the twilled structure is adopted, the limit number of wefts to be placed can be increased as compared with when the satin woven structure is adopted, so that the number of wefts can be increased if there is no problem with respect to air permeability. Accordingly, the twilled structure is advantageous when fiber supportability is desired to be improved.

Then, when a lower layer fabric is examined, it is understood that it has a ribbed plain structure in which lower surface side warps 1 and 2, 3 and 4, 5 and 6, and 7 and 8 have the same structure and are aligned parallel to each other. The fabric may have a small thickness and is suitable for use particularly as a papermaker's forming fabric for producing tissues. In an actual fabric, the lower surface side warps 1 and 2 closely contact with each other and lie between and underneath the upper surface side warps 1 and 2. An advantage of adopting the ribbed structure is that as compared with when one thick warp having a cross section equivalent to cross sections of two warps is placed, the same effect as obtained when a warp having a flat cross section is used, so that the thickness of the fabric can be rendered small, and the fabric becomes more weft-friction-type.

Next, a description will be given to binding portions. As is understood from FIG. 1, in the present example, upper surface side warps 1 and 5 and lower surface side warps 1 and 5 serve as binding yarns. Portions where the upper surface side warp 5 and the lower surface side warp 5 cross wefts 9' are binding portions. The upper surface side warp 5 passes under the lower surface side weft 9' (indicated in FIG. 1 by "□") so as to weave the lower surface side weft 9' from the lower surface side, and the lower surface side warp 5 passes over the upper surface side weft 9' (indicated in FIG. 1 by "▲") so as to weave the upper surface side weft 9' from the upper surface side, thereby binding the upper layer fabric and the lower layer fabric to each other.

Incidentally, as described above, an upper surface side warp has a structure that the warp passes under three adjacent upper surface side wefts and then passes over an upper surface side weft. Because the lower surface side warps have a plain woven structure, the upper surface side weft 9' should have been woven by the upper surface side warp 5 from the upper surface side, and the lower surface side weft 9' should have been woven by the lower surface side warp 5 from the lower surface side.

Thus, the upper surface side warp serving as a binding yarn goes to the lower surface side without weaving the upper surface side weft which should have been woven by the upper surface side warp from the upper surface side from the viewpoint of the structure of the upper layer fabric and then weaves the lower surface side weft which should have been woven by the lower surface side warp from the viewpoint of the structure of the lower layer fabric, from the lower surface side. Meanwhile, it can be well understood that in the portion where the upper surface side warp has woven the lower surface side weft from the lower surface side, the lower surface side warp serving as a binding yarn goes up to the upper surface side without weaving the upper surface side weft which should have been woven by the upper surface side warp from the viewpoint of the structure of the lower layer fabric and then weaves the upper surface side weft which should have been woven by the upper surface side warp from the viewpoint of the structure of the upper layer fabric, from the upper surface side.

Further, it can also be well understood that, in the portion where no support by the upper surface side warp is available because the warp descends to the lower surface side and where local excessive dewatering occurs and causes problems such as a fiber carryback and a splash in the prior art, the lower surface side warp ascends to the upper surface side and provides support in place of the upper surface side warp and, in the portion where the lower surface side warp is absent by going up to the upper surface side so as to support the upper surface side, the upper surface side warp goes down to the lower surface side and supports the lower surface side, thereby forming a structure that the upper surface side warp and the lower surface side warp complement each other.

Further, since the upper surface side warp weaves the lower surface side weft which should have been woven by the lower surface side warp and the lower surface side warp weaves the upper surface side weft which should have been woven by the upper surface side warp, the structures of the upper and lower layer fabrics substantially do not become out of shape, and good wire mark properties can be attained.

In the present example, the ratio of the upper surface side wefts to the lower surface side wefts is set at 2:1; the proportion of warps provided to serve as binding yarns is ¼ of all warps; an upper surface side warp has a structure that after the warp weaves an upper surface side weft for 3 times from the upper surface side, it goes down to the lower surface side so as to weave a lower surface side weft from the lower surface side; and a lower surface side warp has a structure that after the warp weaves a lower surface side weft for 3 times from the lower surface side, it goes up to the upper surface side so as to weave an upper surface side weft from the upper surface side. As a matter of course, the present invention is not limited to the above. However, this ratio is suitable because air permeability, rigidity, wire mark properties and other properties are well-balanced.

When the binding force between the upper and lower layer fabrics is desired to be increased, the proportion of the warps serving as binding yarns or the number of binding portions should be increased. Meanwhile, when air permeability is desired to be improved, the proportion of the warps serving as binding yarns or the number of the binding portions should be decreased.

Figure 2:
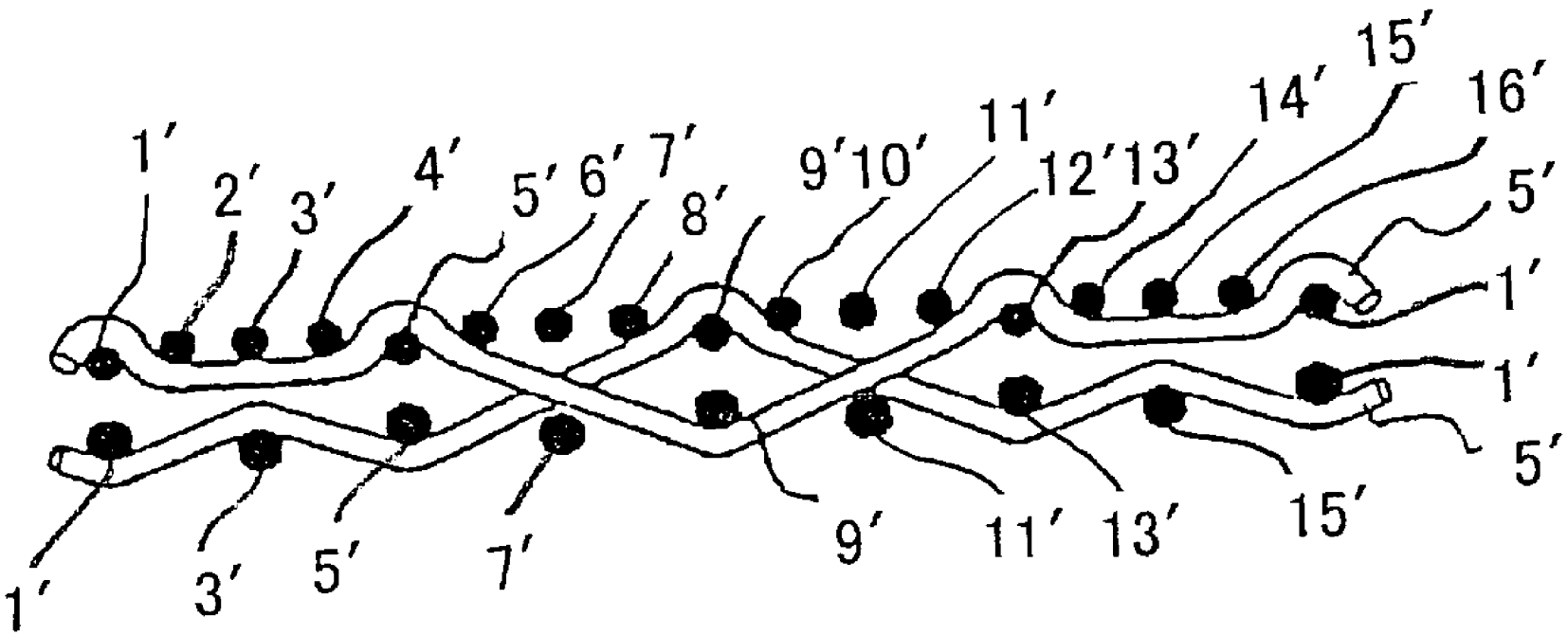
FIG. 2 is a sectional view along a warp of the repeating unit sectioned along the line II—II of FIG. 1.

FIG. 2 is a sectional view along a weft of the repeating unit sectioned along the line A–A' of FIG. 1. It can be well understood that an upper surface side warp and a lower surface side warp complement each other, and except for portions where the warps weave upper surface side wefts from the upper surface side, the warps always exist between upper surface side wefts and lower surface side wefts, so that there exist no portions where the warp passes under the upper layer fabric and thereby local excessive dewatering occurs and causes problems such as a fiber carryback and a splash.

EXAMPLE 2

Figure 3:
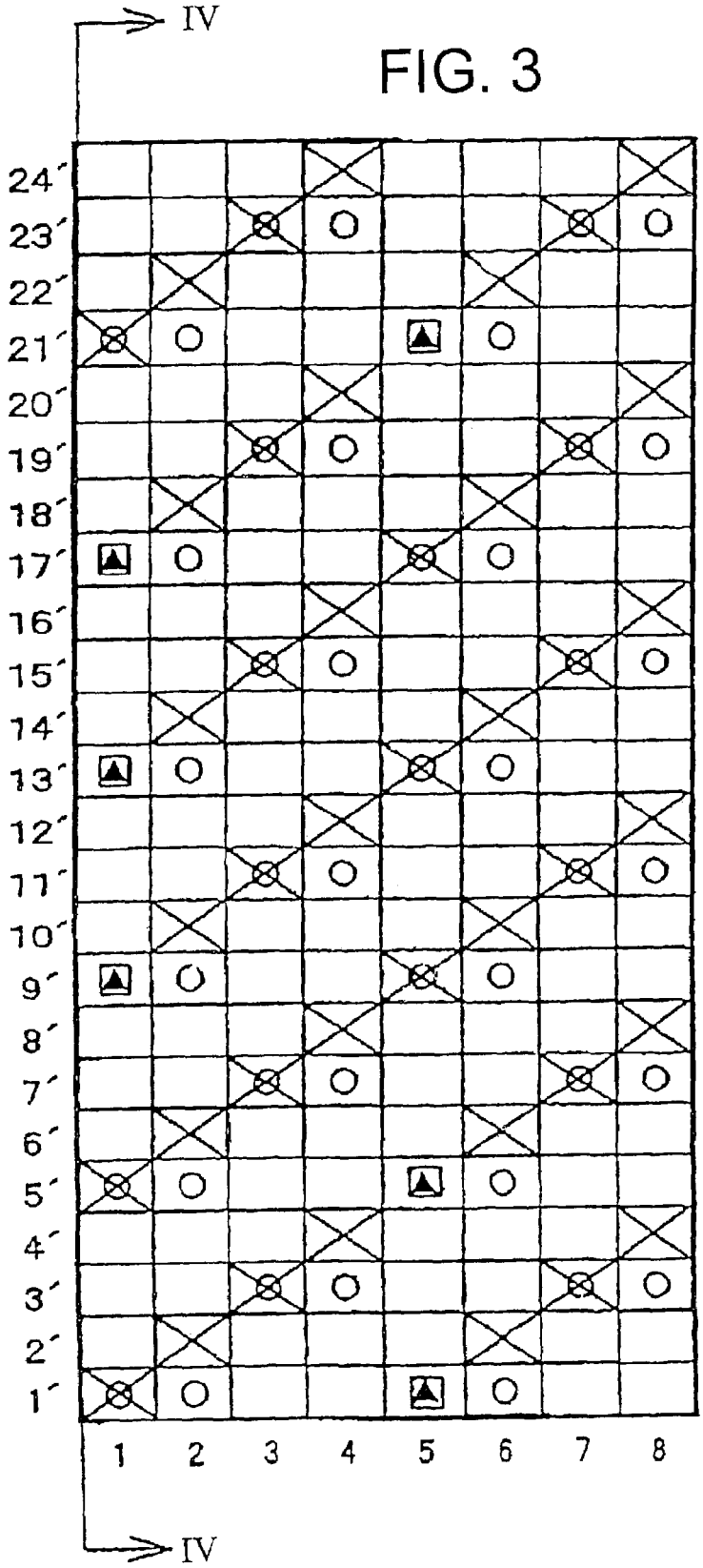
FIG. 3 is a diagram illustrating a repeating unit of Example 2 of the present invention.

FIG. 3 is a diagram illustrating a repeating unit of Example 2 of the present invention. The placement of warps and wefts is the same as that in Example 1. Lower surface side wefts are placed underneath upper surface side wefts represented by odd numbers, and the upper layer fabric of the repeating unit has 24 wefts. The structures of the upper and lower layer fabrics are the same as those in Example 1. The upper layer fabric has a structure in which an upper surface side warp passes under three adjacent upper surface side wefts and then passes over an upper surface side weft. The lower layer fabric has a plain woven structure in which two adjacent lower surface side warps are formed parallel to each other. Example 2 is different from Example 1 in that while a warp serving as a binding yarn in each layer weaves and binds only one weft in the other layer in Example 1, the repeating unit of Example 2 has binding sites in which a binding portion formed by a warp passing over or under a weft is woven three times in a raw. Although the warp ⅓ structure of the upper layer fabric is unchanged as a whole, the number of times a warp weaves wefts in the two layers increases, so that a binding force improves.

As can be seen from FIG. 3, in the present example, upper surface side warps 1 and 5 and lower surface side warps 1 and 5 serve as binding yarns. The upper surface side warp 1 and the lower surface side warp 1 cross wefts 9', 13' and 17' so as to form binding portions. The upper surface side warp 1 passes under the lower surface side wefts 9', 13' and 17' (indicated in FIG. 3 by "□") so as to weave the lower surface side wefts from the lower surface side, and the lower surface side warp 1 passes over the upper surface side wefts 9', 13' and 17' (indicated in FIG. 3 by "▲") so as to weave the upper surface side wefts from the upper surface side, thereby binding the upper layer fabric and the lower layer fabric to each other.

Incidentally, as described above, an upper surface side warp has a structure that the warp passes under three adjacent upper surface side wefts and then passes over an upper surface side weft. Because lower surface side warps have a plain woven structure, the upper surface side wefts 9', 13' and 17' should have been woven by the upper surface side warp 1 from the upper surface side, and the lower surface side wefts 9', 13' and 17' should have been woven by the lower surface side warp 1 from the lower surface side.

Thus, it can be well understood that the upper surface side warp 1 serving as a binding yarn goes down to the lower surface side without weaving the upper surface side wefts 9', 13' and 17' which should have been woven by the upper surface side warp 1 from the upper surface side, i.e., without weaving the three times upper surface side wefts to be woven successively, from the viewpoint of the structure of the upper layer fabric; weaves the lower surface side wefts 9', 13' and 17' which should have been woven by the lower surface side warp from the viewpoint of the structure of the lower layer fabric, from the lower surface side; then goes up to the upper surface side again so as to weave an upper surface side weft from the upper surface side, thereby serving as a binding yarn, whereas the lower surface side warp weaves the upper surface side wefts 9', 13' and 17' which should have been woven by the upper surface side warp 1 from the viewpoint of the structure of the upper layer fabric, from the upper surface side; and then goes down to the lower surface side again so as to weave a lower surface side weft from the lower surface side, thereby serving as a binding yarn.

Thus, since the upper surface side warp and the lower surface side warp complement each other, conventionally occurring problems such as local excessive dewatering, a fiber carryback and a splash can be eliminated.

Further, since the upper surface side warp weaves the lower surface side wefts which should have been woven by the lower surface side warp and the lower surface side warp weaves the upper surface side wefts which should have been woven by the upper surface side warp, the structures of the upper and lower layer fabrics substantially do not become out of shape, and good wire mark properties can be attained.

Figure 4:
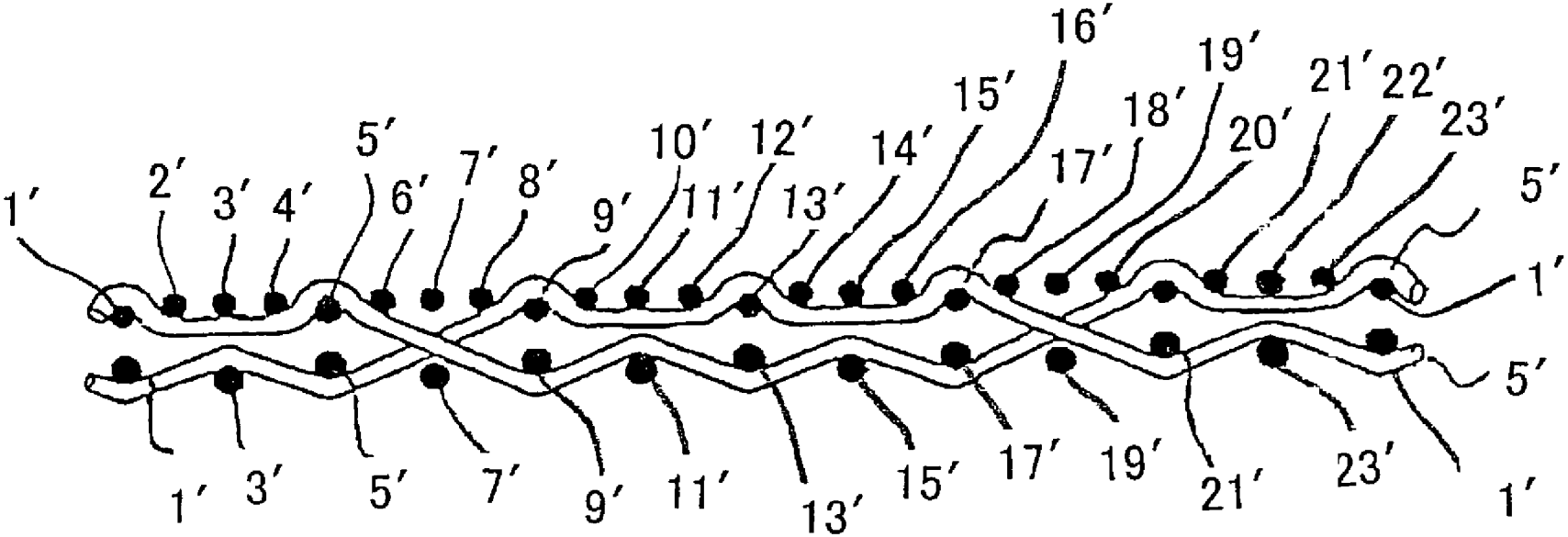
FIG. 4 is a sectional view along a warp of the repeating unit sectioned along the line IV—IV of FIG. 1.

FIG. 4 is a sectional view along a warp of the repeating unit sectioned along the line B–B' of FIG. 3. It can be well understood that an upper surface side warp and a lower surface side warp complement each other, and except for portions where the warps weave upper surface side wefts from the upper surface side, the warps always exist between upper surface side wefts and lower surface side wefts, so that there exist no portions where problems such as local excessive dewatering, a fiber carryback and a splash occur due to the absence of the warp.

EXAMPLE 3

Figure 5:
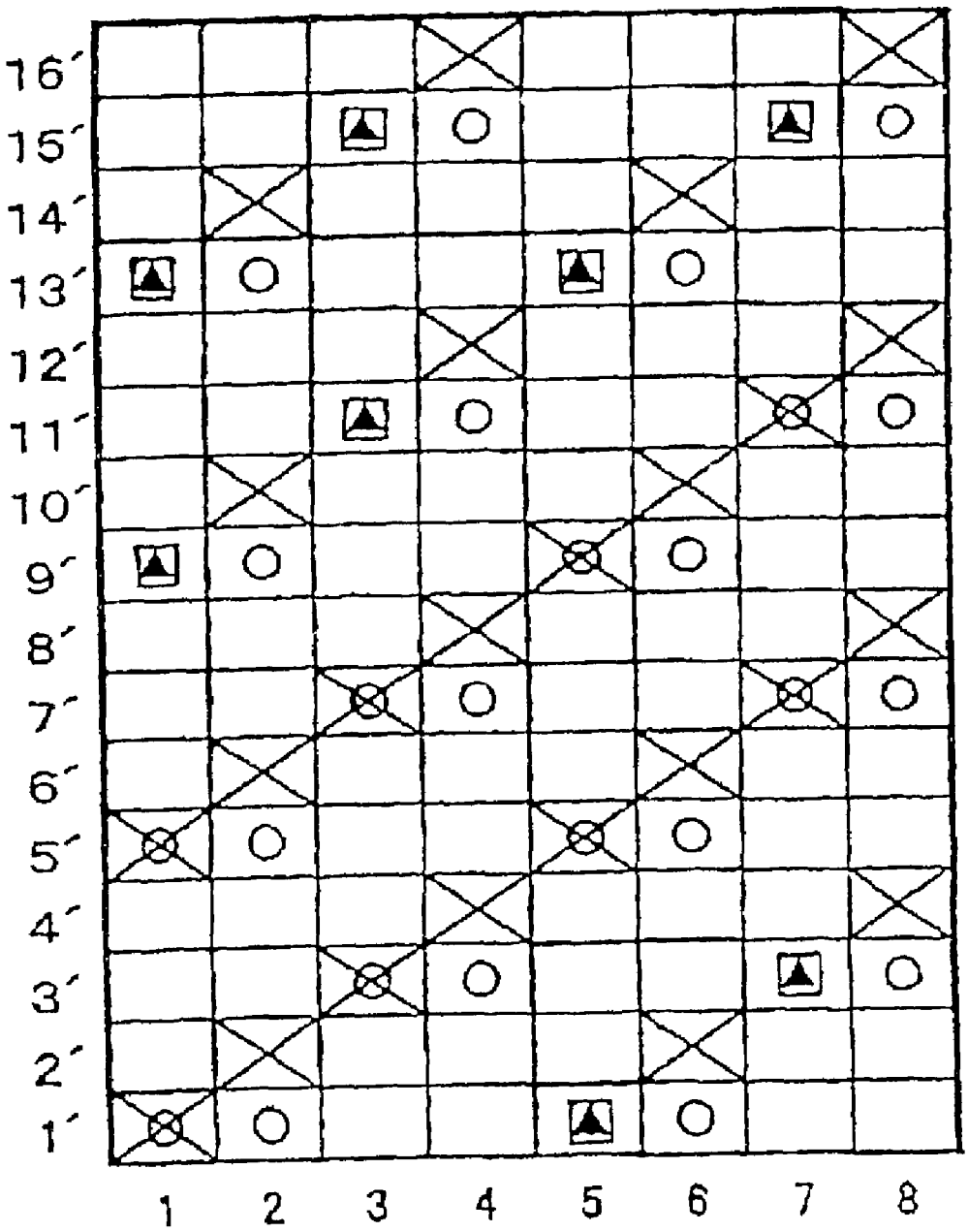
FIG. 5 is a diagram illustrating a repeating unit of Example 3 of the present invention.

FIG. 5 is a diagram illustrating a repeating unit of Example 3 of the present invention. The repeating unit of Example 3 comprises 8 warps and 16 wefts. A warp serving as a binding yarn weaves a weft two times in a row so as to form biding portions. The proportion of warps provided as binding yarns is ½ of all upper surface side warps. An upper surface side warp has a structure that after the warp weaves two times upper surface side wefts from the upper surface side, it goes down to the lower surface side so as to weave two times lower surface side wefts from the lower surface side and then goes up to the upper surface side so as to weave two times upper surface side wefts from the upper surface side. Although the warp ⅓ structure of the upper layer fabric is unchanged, the proportion of the warps provided as binding yarns has been increased, so that a binding force has improved and adhesion between the upper and lower layer fabrics has become very good.

EXAMPLE 4

Figure 6:
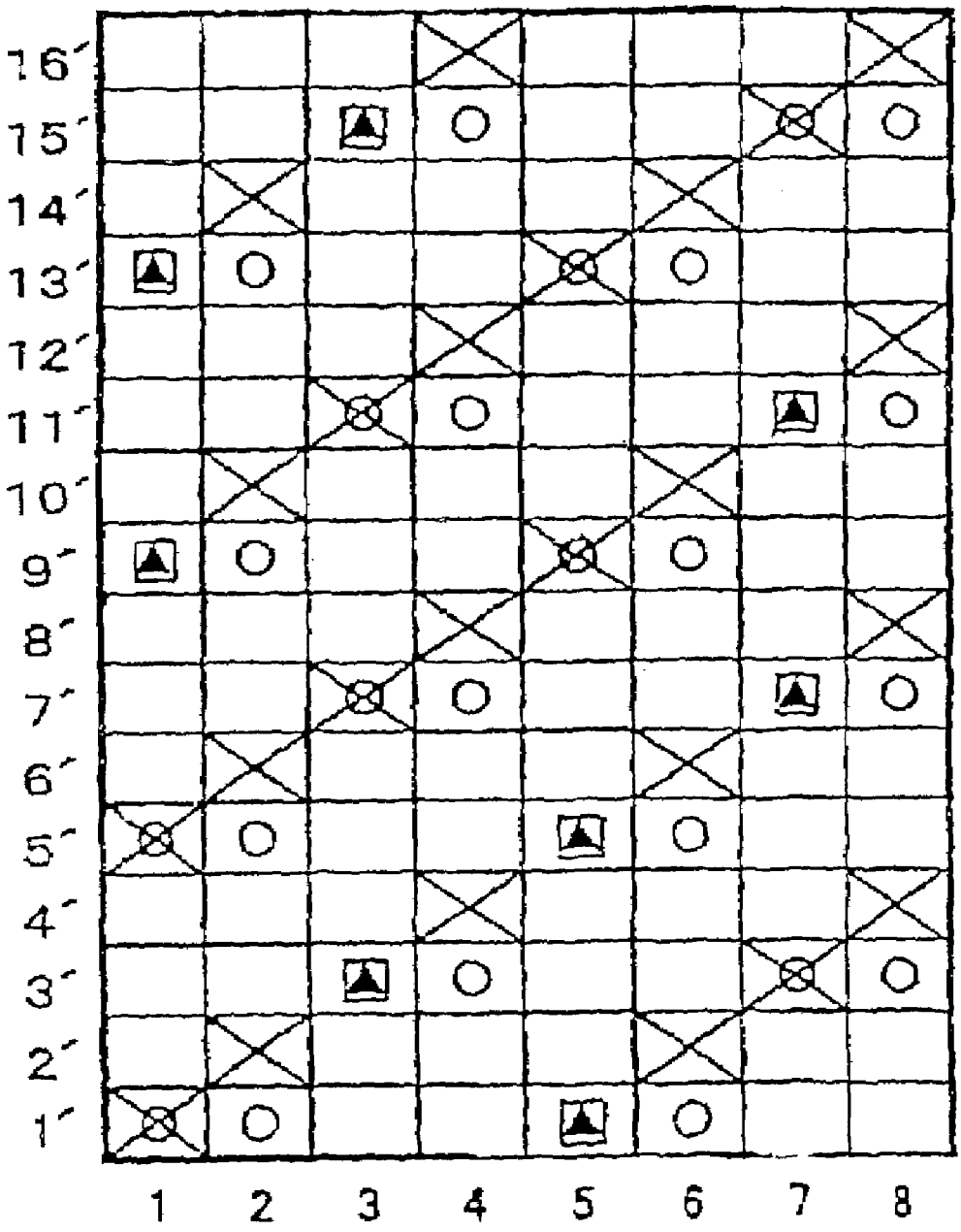
FIG. 6 is a diagram illustrating a repeating unit of Example 4 of the present invention.

FIG. 6 is a diagram illustrating a repeating unit of Example 4 of the present invention.

The repeating unit of Example 4 is similar to but different from Example shown in FIG. 5 in that warps serving as binding yarns are shifted irregularly. The repeating unit of Example 4 has an advantage that diagonal wire marks are not conspicuous since binding portions are not continuous diagonally.

EXAMPLE 5

Figure 7:
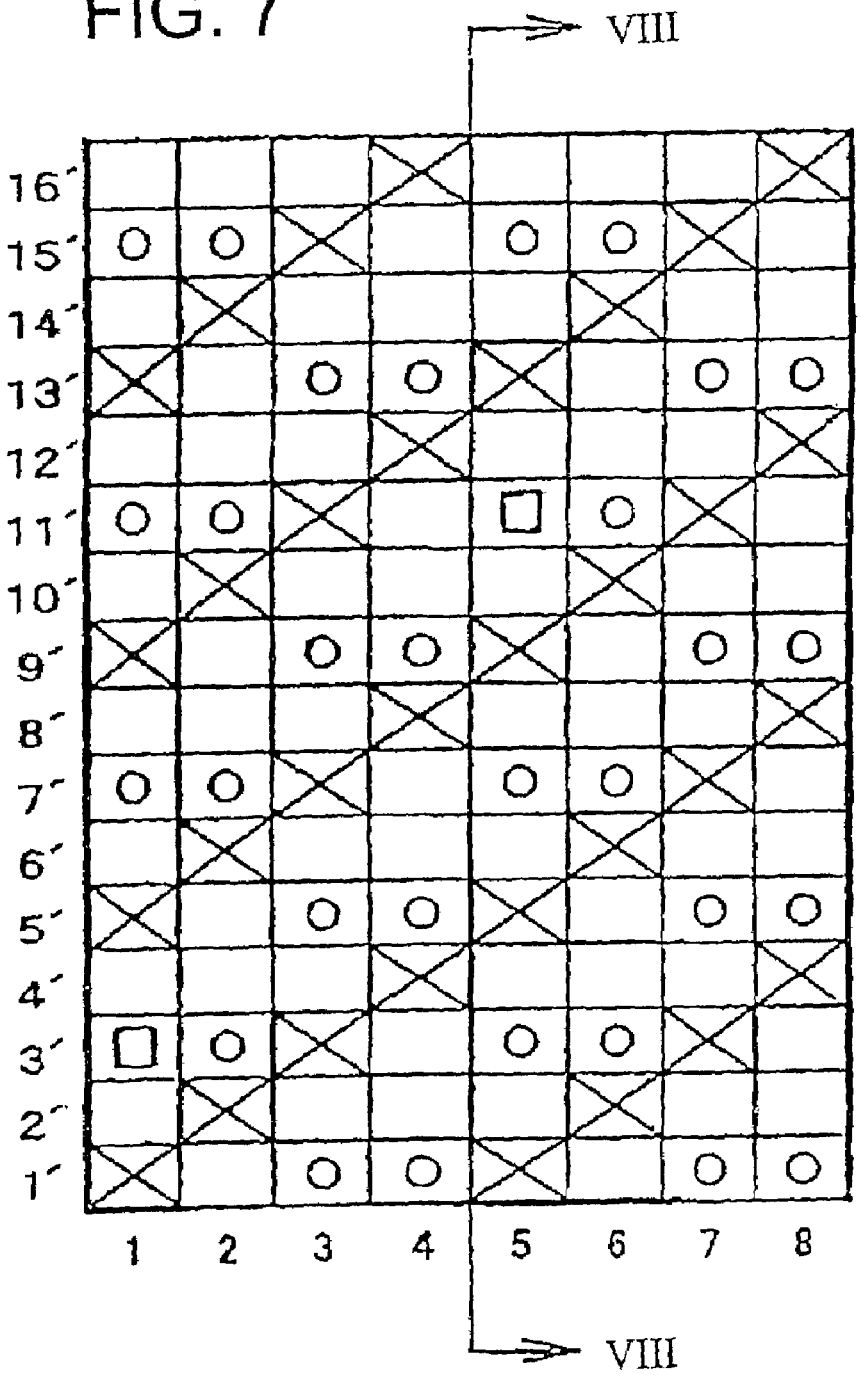
FIG. 7 is a diagram illustrating a repeating unit of Example 5 of the present invention.

FIG. 7 is a diagram illustrating a repeating unit of Example 5 of the present invention.

The placement of warps and wefts is the same as that in Example 1. The proportion of warps provided as binding yarns is ¼ of all upper surface side warps. The structures of the upper and lower layer fabrics are the same as those in Examples 1 to 4. The upper layer fabric has a structure in which an upper surface side warp passes under three adjacent upper surface side wefts and then passes over an upper surface side weft. The lower layer fabric has a plain woven structure in which two adjacent lower surface side warps are formed parallel to each other. Example 5 is different from Example 1 in that a lower surface side warp which is paired with an upper surface side warp serving as a binding yarn does not appear on the surface of the upper layer fabric at a binding site of the upper surface side warp but lie between upper surface side wefts and lower surface side wefts.

As can be seen from FIG. 7, in the present example, upper surface side warps 1 and 5 serve as binding yarns. The upper surface side warp 5 crosses a weft 11' so as to form a binding portion. The upper surface side warp 5 passes under the lower surface side weft 11' (indicated in FIG. 7 by "□") so as to weave the lower surface side weft from the lower surface side, thereby binding the upper layer fabric and the lower layer fabric to each other.

Incidentally, as described above, since lower surface side warps have a plain woven structure, the lower surface side weft 11' should have been woven by a lower surface side warp 5 from the lower surface side.

Thus, it can be well understood that the upper surface side warp 5 serving as a binding yarn goes down to the lower surface side between sites where the upper surface side warp 5 weaves upper surface side wefts 9' and 13' so as to weave the lower surface side weft 11' which should have been woven by the lower surface side warp 5 from the viewpoint of the structure of the lower layer fabric, from the lower surface side, and that in the portion where the upper surface side warp 5 goes down to the lower surface side and weaves the lower surface side weft 11' from the lower surface side, the lower surface side warp 5 passes between the upper and lower surface side wefts without weaving the lower surface side weft 11' which should have been woven by the lower surface side warp 5 from the lower surface side from the viewpoint of the structure of the lower layer fabric.

Thus, the lower surface side warp 5 passes between upper surface side wefts 10', 11' and 12' and the lower surface side weft 11' so as to support the upper layer fabric in place of the lower surface side warp 5. Meanwhile, in the lower layer fabric, in the portion where the lower surface side warp 5 is absent because it passes between the upper and lower layer fabrics so as to support the upper layer fabric, the upper surface side warp 5 goes down to the lower surface side and weaves the lower surface side weft 11' so as to support the lower layer fabric. Thus, the upper surface side warp and the lower surface side warp complement each other.

Further, since the upper surface side warp weaves the lower surface side weft which should have been woven by the lower surface side warp, the structures of the upper and lower layer fabrics substantially do not become out of shape, and good wire mark properties can be attained.

In the present example, the ratio of the upper surface side wefts to the lower surface side wefts is set at 2:1; the proportion of warps provided to serve as binding yarns is ¼ of all upper surface side warps; and an upper surface side warp has a structure that after it weaves an upper surface side weft for 4 times from the upper surface side, it goes down to the lower surface side so as to weave a lower surface side weft from the lower surface side.

Figure 8:
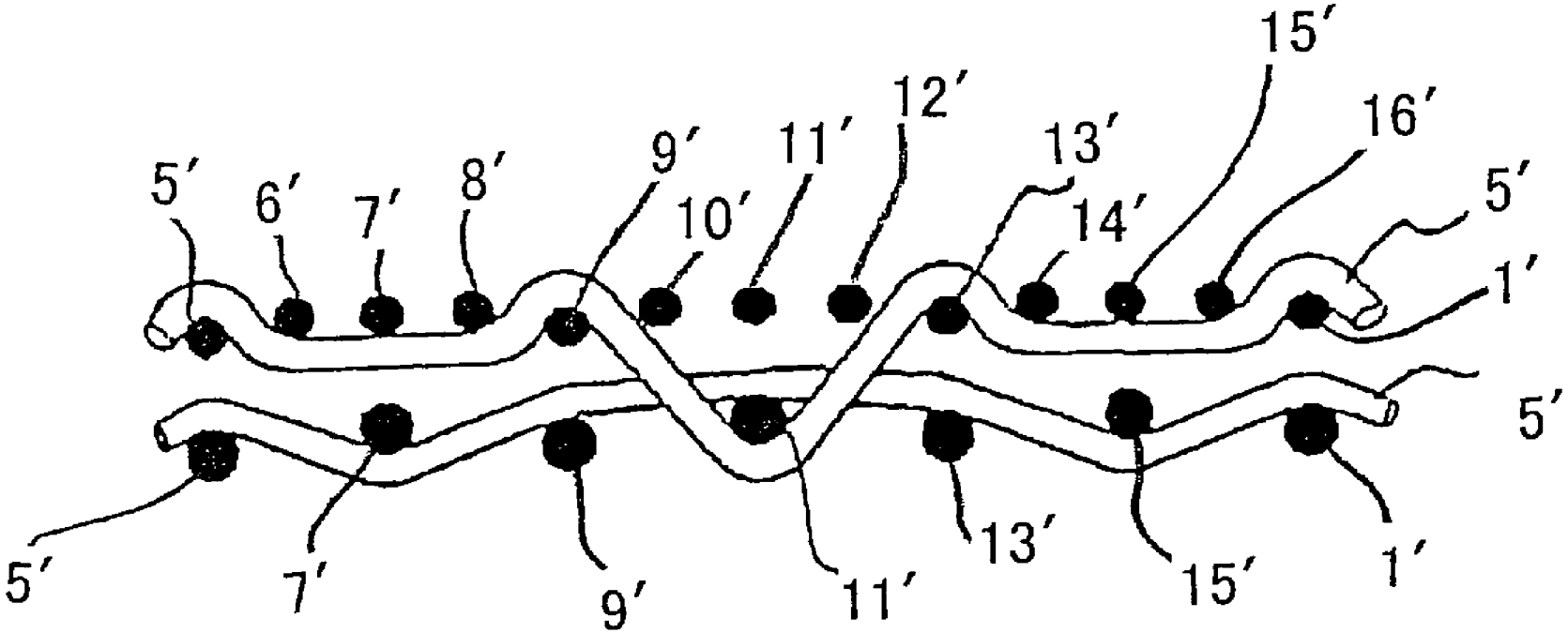
FIG. 8 is a sectional view along a warp of the repeating unit sectioned along the line VIII—VIII of FIG. 7.

FIG. 8 is a sectional view along a warp of the repeating unit sectioned along the line C–C' of FIG. 7. It can be well understood that in a portion where an upper surface side warp is absent because it goes to the lower surface side, a lower surface side warp passes between upper and lower surface side wefts so as to support the upper layer fabric in place of the upper surface side warp, and except for portions where the warp weaves upper surface side wefts from the upper surface side, the warp always exists between upper and lower surface side wefts, so that there exist no portions where problems such as local excessive dewatering, a fiber carryback and a splash occur due to the absence of the warp.

EXAMPLE 6

Figure 9:
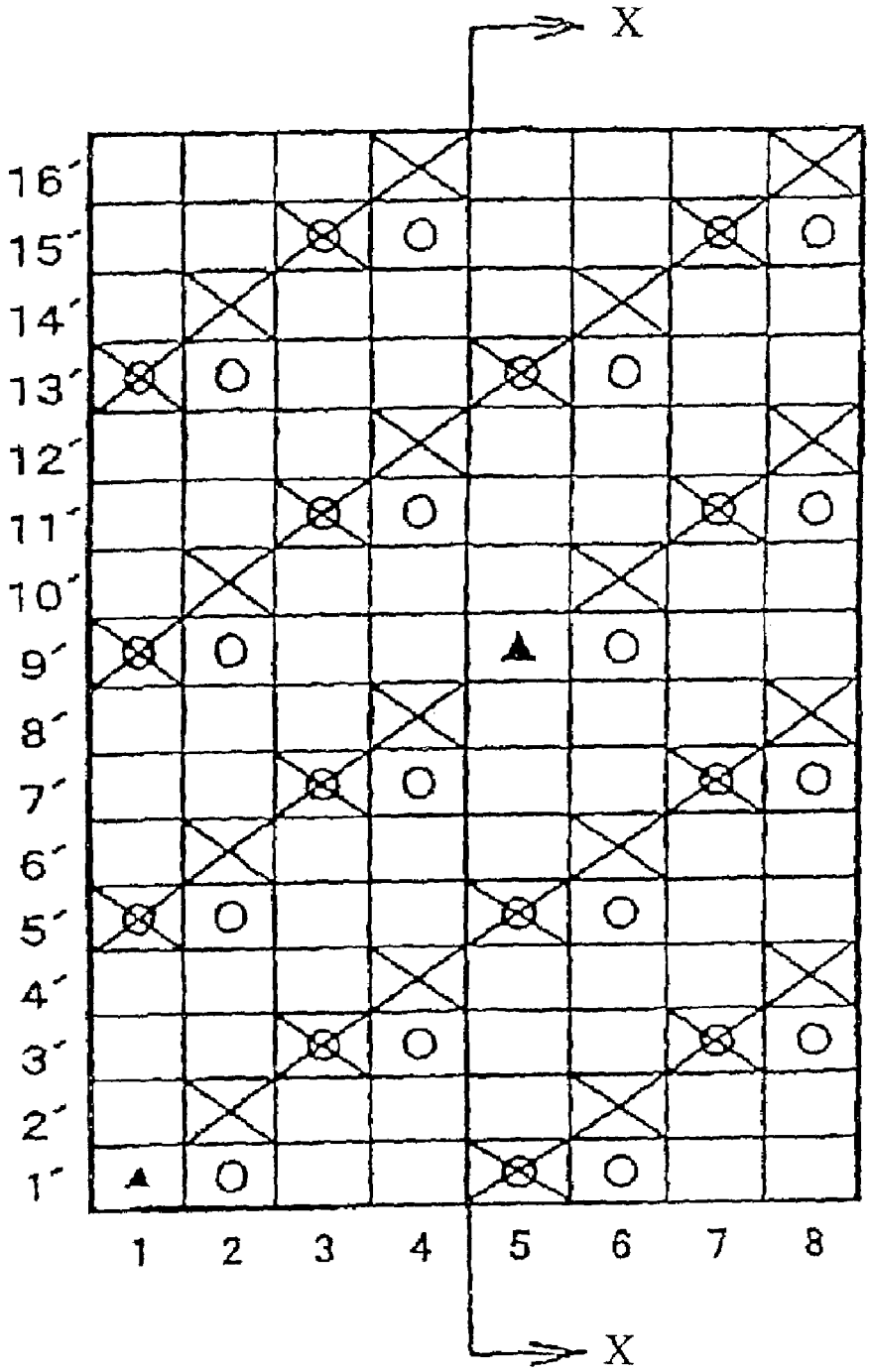
FIG. 9 is a diagram illustrating a repeating unit of Example 6 of the present invention.

FIG. 9 is a diagram illustrating a repeating unit of Example 6 of the present invention.

The placement of warps and wefts is the same as that in Example 1. The proportion of warps provided as binding yarns is ¼ of all upper surface side warps. The structures of the upper and lower layer fabrics are the same as those in Examples 1 to 5. The upper layer fabric has a structure in which an upper surface side warp passes under three adjacent upper surface side wefts and then passes over an upper surface side weft. The lower layer fabric has a plain woven structure in which two adjacent lower surface side warps are formed parallel to each other. Example 6 is different from Example 1 in that an upper surface side warp which is paired with a lower surface side warp serving as a binding yarn does not appear on the surface of the upper layer fabric at a binding site of the lower surface side warp but lie between upper surface side wefts and lower surface side wefts.

As can be seen from FIG. 9, in the present example, upper surface side warps 1 and 5 serve as binding yarns. A lower surface side warp 5 crosses an upper surface side weft 9' so as to form a binding portion. The lower surface side warp 5 passes over a lower surface side weft 9' (indicated in FIG. 9 by "▲") so as to weave the upper surface side weft 9' from the upper surface side, thereby binding the upper layer fabric and the lower layer fabric to each other.

Incidentally, as described above, an upper surface side warp has a structure that the upper surface side warp passes under three adjacent upper surface side wefts and then passes over an upper surface side weft. Therefore, the upper surface side weft 9' should have been woven by the upper surface side warp 5 from the upper surface side. However, the upper surface side warp 5 passes between upper and lower surface side wefts without weaving the upper surface side weft 9' which should have been woven by the upper surface side warp 5. Further, it can be well understood that, in the portion where the upper surface side warp 5 passes between the upper and lower surface side wefts without weaving the upper surface side weft 9', the lower surface side warp 5 goes up to the upper surface side without weaving the lower surface side weft 9' which should have been woven by the lower surface side warp 5 from the lower surface side from the viewpoint of the structure of the lower layer fabric and then weaves the upper surface side weft 9' which should have been woven by the lower surface side warp 5 from the viewpoint of the structure of the upper layer fabric, from the upper surface side.

Further, since the lower surface side warp weaves the upper surface side weft which should have been woven by the upper surface side warp, the structure of the upper layer fabric substantially does not become out of shape, and good wire mark properties can be attained.

In the present example, the ratio of the upper surface side wefts to the lower surface side wefts is set at 2:1; the proportion of warps provided to serve as binding yarns is ¼ of all upper surface side warps; and a lower surface side warp has a structure that after it weaves a lower surface side weft for 3 times from the lower surface side, it goes up to the upper surface side and weave an upper surface side weft from the upper surface side.

Figure 10:
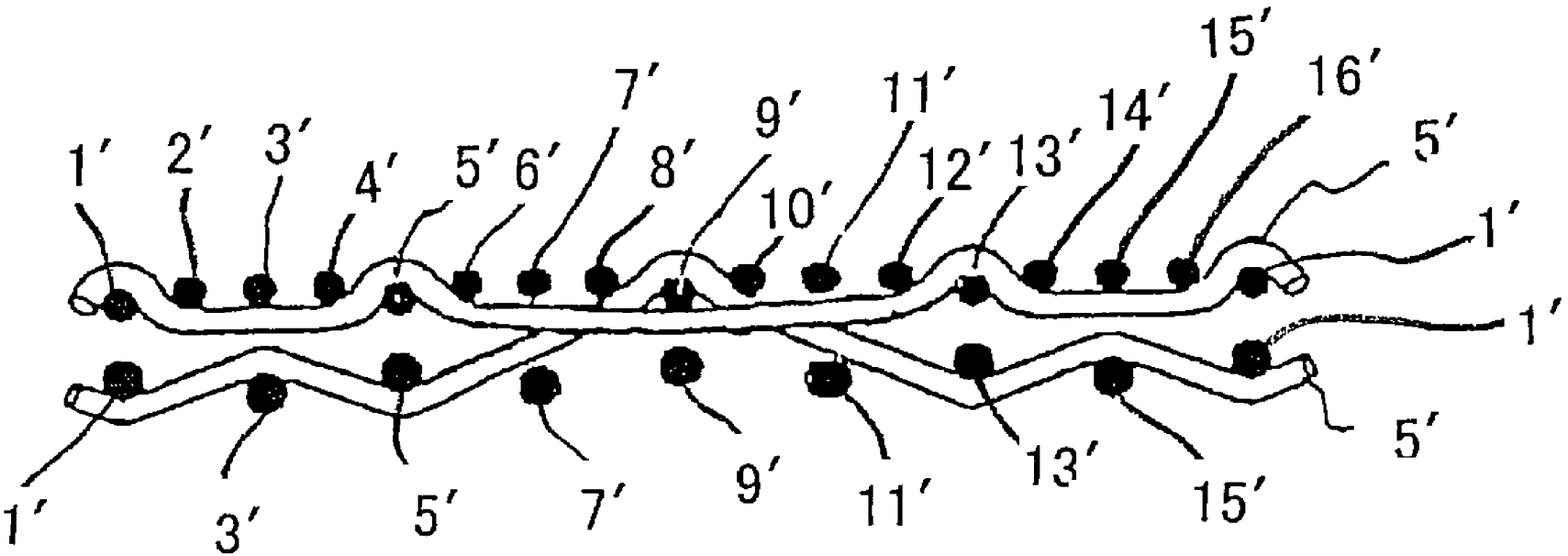
FIG. 10 is a sectional view along a warp of the repeating unit sectioned along the line X—X of FIG. 9.

FIG. 10 is a sectional view along a warp of the repeating unit sectioned along the line D–D' of FIG. 9.

It can be well understood that in a portion where a lower surface side warp goes up to the upper surface side and weaves an upper layer weft from the upper surface side so as to bind the upper layer fabric to the lower layer fabric, an upper surface side warp passes between upper and lower surface side wefts, so that there exist no portions where problems such as local excessive dewatering, a fiber carryback and a splash occur due to the absence of the warp.

EXAMPLE 7

Figure 11:
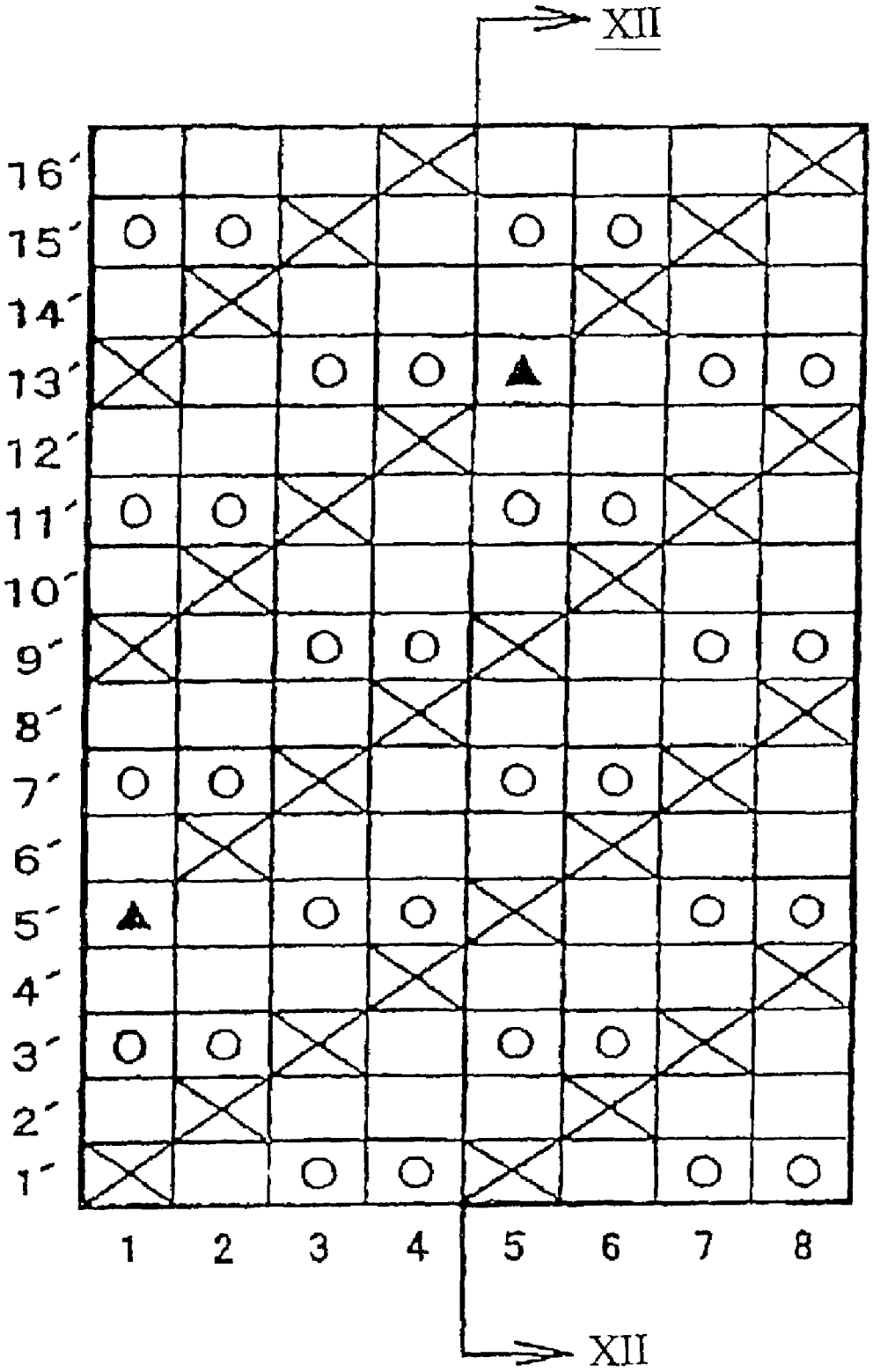
FIG. 11 is a diagram illustrating a repeating unit of Example 7 of the present invention.

FIG. 11 is a diagram illustrating a repeating unit of Example 7 of the present invention.

In Example 6 of FIG. 10, in a binding portion, a lower surface side warp goes up to the upper surface side without weaving a lower surface side weft which should have been woven by the lower surface side warp from the lower surface side from the viewpoint of the structure of the lower layer fabric and then weaves an upper surface side weft from the upper surface side. Meanwhile, the present example has a structure that a lower surface side warp serving as a binding yarn weaves a lower surface side weft which should have been woven by the lower surface side warp from the lower surface side, goes up to the upper surface side so as to weave an upper surface side weft from the upper surface side, and then goes back to the lower surface side so as to weave a lower surface side weft which should have been woven by the lower surface side warp from the lower surface side. By adopting the above structure, the structure of the lower layer fabric substantially does not become out of shape, and wire mark properties and the like are further improved.

Figure 12:
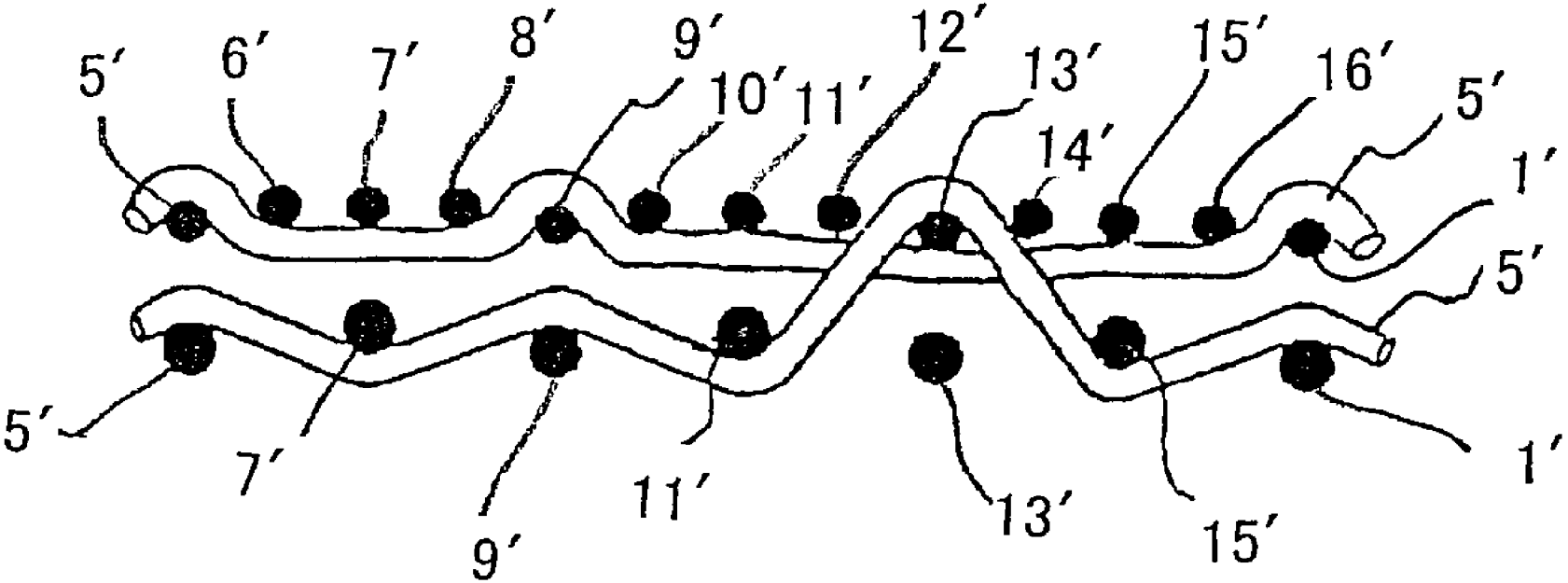
FIG. 12 is a sectional view along a warp of the repeating unit sectioned along the line XII—XII of FIG. 11.

FIG. 12 is a sectional view along a warp of the repeating unit sectioned along the line E–E' of FIG. 11.

A lower surface side warp 5 weaves a lower surface side weft 11' which should have been woven by the lower surface side warp 5 from the lower surface side, goes up to the upper surface side so as to weave an upper surface side weft 13' from the upper surface side, and then goes back to the lower surface side so as to weave a lower surface side weft 15' which should have been woven by the lower surface side warp 5 from the lower surface side. Thus, it can be well understood that since lower surface side warps pass over and under lower surface side wefts, the structure of the lower layer fabric is not out of shape.

Example of Prior Art

Figure 13:
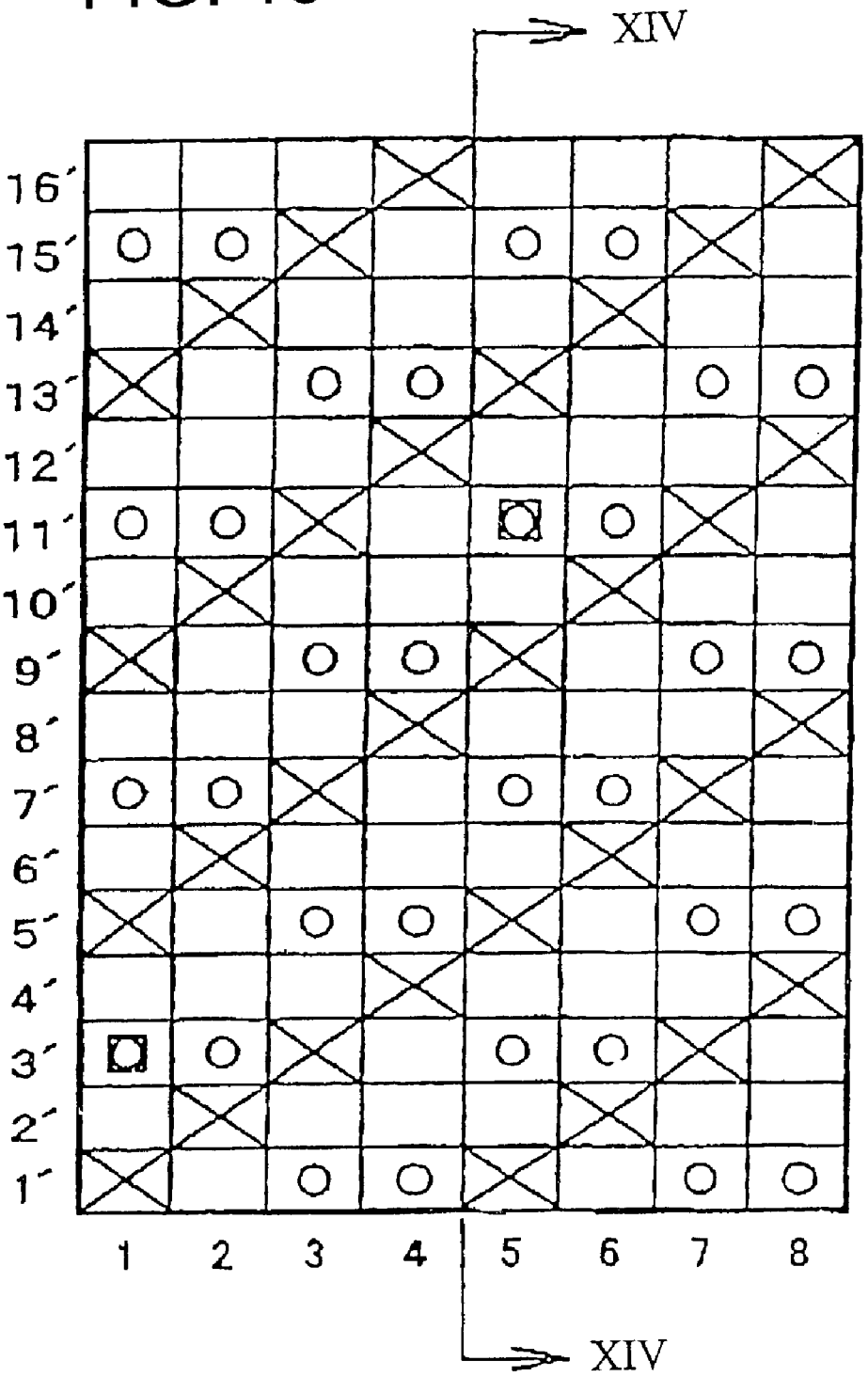
FIG. 13 is a diagram illustrating a repeating unit of a conventional example of the present invention.
Figure 14:
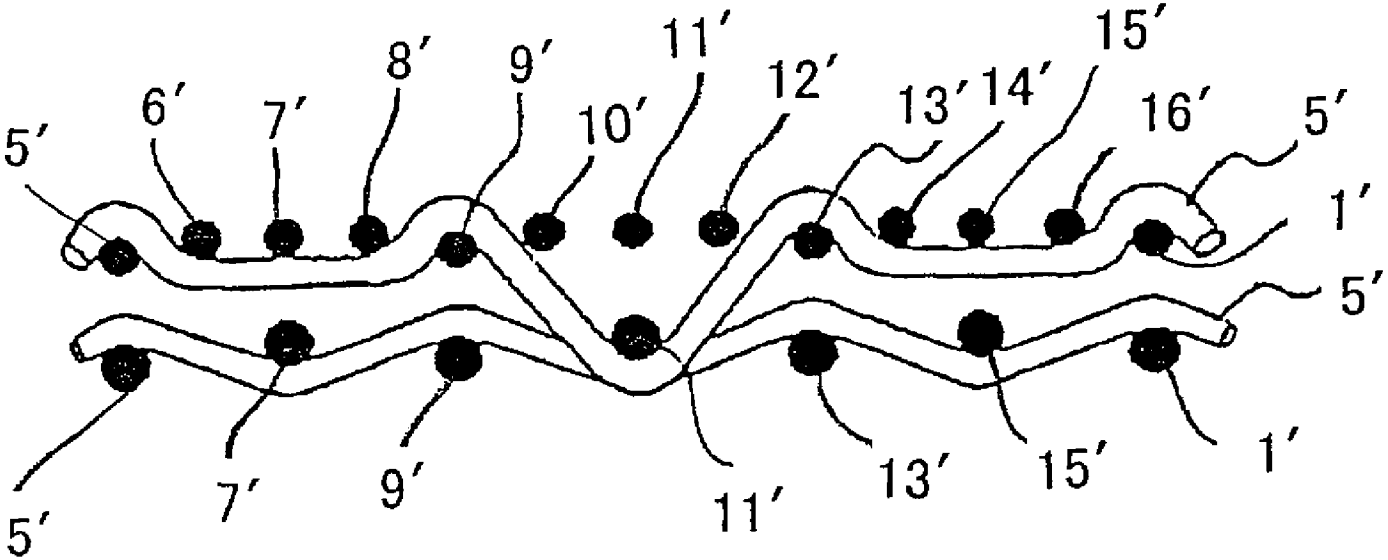
FIG. 14 is a sectional view along a warp of the repeating unit sectioned along the line XIV—XIV of FIG. 13.

FIG. 13 is a diagram illustrating a repeating unit of an example of the prior art which is disclosed in EP0889160A1. FIG. 14 is a sectional view along a warp of the repeating unit sectioned along the line F–F' of FIG. 13. As is seen from FIGS. 13 and 14, the basic structures of the upper and lower layer fabrics are the same as those in Examples. However, the structure of a binding portion is different and has a problem.

Upper surface side warps 1 and 5 serve as binding yarns. The upper surface side warp 5 crosses a weft 11' so as to form a binding portion. Between portions where the upper surface side warp 5 weaves upper surface side wefts 9' and 13', the upper surface side warp 5 goes down to the lower surface side, passes under the lower surface side weft 11' (indicated in FIG. 13 by "□") and weaves the lower surface side weft 11' from the lower surface side so as to bind the upper layer fabric and the lower layer fabric to each other. In the binding portion, no warp is present between upper surface side wefts and the lower surface side weft and supports the upper layer fabric, thereby forming a portion where local excessive dewatering occurs and causes problems such as a fiber carryback and a splash and the like.

Further, on the lower surface side of the binding portion, lower surface side warps 5 and 6 and the upper surface side warp 5 are placed in close contact with and parallel to one another, and the structure of the lower layer fabric becomes out of shape, thereby causing the occurrence of a wire mark.

Comparisons by Actual Device Test

The fabric of Example 1 shown in FIG. 1 and the fabric of an example of the prior art shown in FIG. 13 were subjected to an actual paper machine for producing tissues so as to carry out an actual device test. When the fabric of the prior art was used, many fiber carrybacks and splashes were produced at a paper making speed of 1,800 m/min, many pinholes were also produced, so that the paper making rate had to be reduced, and weft yarn marks on paper were also conspicuous. In contrast, in the case of the fabric of Example, no such problems occurred even at a paper making rate of 1,800 m/min, and good paper making could be carried out.

In an industrial two-layer fabric of the present invention, owing to the aforementioned structure, wefts can be increased in number with no degradation in freeness (air permeability), and no absence of warps at binding sites in the upper layer fabric occurs and no local excessive dewatering occurs. Therefore, the fabric has good fiber supportability, is free from fiber carrybacks, splashes and the like, and it also has good wire mark properties.

The disclosure of Japanese Patent Application Nos. 2002-150216 filed on May 24, 2002, 2002-197018 filed on Jul. 5, 2002, 2002-197058 filed on Jul. 5, 2002, and 2002-224817 filed Aug. 1, 2002 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. An industrial two-layer fabric which comprises an upper layer fabric comprising upper surface side warps and upper surface side wefts and a lower layer fabric comprising lower surface side warps and lower surface side wefts, wherein the upper layer fabric and the lower layer fabric are bound to each other at at least one spot in a repeating unit of the two-layer fabric where a first upper surface side warp weaves a first lower surface side weft at least once without weaving a first upper surface side weft and where a first lower surface side warp weaves the first upper surface side wefts without weaving the first lower surface side weft, wherein a second upper surface side warp weaves only the upper surface side wefts, wherein a second lower surface side warp weaves only the lower surface side wefts, and wherein the first upper surface side warp and the first lower surface side warp deviate from a weaving structure of the second upper surface side warp and the second lower surface side warp, respectively, at the at least one spot where the upper layer fabric and the lower layer fabric are bound to each other;

further wherein a second lower surface side warp disposed adjacent to the first upper surfae side warp lies under a lower surface side weft at a place adjacent to where the first upper side warp lies under the lower surface side weft.

2. The fabric of claim 1, wherein the first upper and lower surface side warps have different weaving structures in the repeating unit.

3. The fabric of claim 1, wherein the first upper and lower surface side warps have the same weaving structure in the repeating unit.

4. An industrial two-layer fabric which comprises an upper layer fabric comprising upper surface side warps and upper surface side wefts and a lower layer fabric comprising lower surface side warps and lower surface side wefts, wherein the upper layer fabric and the lower layer fabric are bound to each other at at least one spot in a repeating unit of the two-layer fabric where a first upper surface side warp weaves a lower surface side weft and where a first lower surface side warp weaves a first upper surface side weft, wherein the second upper surface side warp weaves only upper surface side wefts, and wherein the first upper surface side warp deviates from a weaving structure of the second upper surface side warp at the at least one spot where the upper layer fabric and the lower layer fabric are bound to each other;

further wherein a second lower surface side warp disposed adjacent to the first upper surface side warp lies under a lower surface side weft at a place adjacent to where the first upper side warp lies under the lower surface side weft.

5. The fabric of claim 4, wherein the first upper surface side warp passes between the upper and lower layer fabrics without weaving the first upper and lower side wefts.

6. The fabric of claim 1 or 4, wherein the upper layer fabric and the lower layer fabric are bound to each other at the two or more successive spots in the repeating unit.

7. The fabric of claims 1 to 4, wherein, in a repeating unit, an upper surface side warp passes under three adjacent upper surface side wefts and then passes over an upper surface side weft, an upper surface side weft passes over three adjacent upper surface side warps forming a long crimp in the upper layer fabric and then passes under an upper surface side warp, and wherein, in a repeating unit, a ribbed plain weave structure is used, the ribbed plain weave comprises two adjacent lower surface side warps placed parallel to each other in the same manner in the repeating unit.

8. The fabric of claim 1or 4, wherein the upper layer fabric includes a plurality of first upper surface side warps and a plurality of second upper surface side warps, and where a ratio of first upper surface side warps to second upper surface side warps is at least 2:1.

9. The fabric according to claim 1 or 4, wherein the number of the upper surface side wefts woven by the first upper surface side warp is greater than the number of lower surface side wefts woven by the first upper surface side warp.

10. The fabric according to claim 1 or 4, wherin the number of teh lower surface side wefts woven by the first lower surface side warp is greater than the number of upper surface side wefts woven by the first lower surface side warp.

11. An industrial two-layer fabric which comprises an upper layer fabric comprising upper surface side warps and upper surface side wefts and a lower layer fabric comprising lower surface side warps and lower surface side wefts, wherein the upper layer fabric and the lower layer fabric are bound to each other at at least one spot in a repeating unit of the two-layer fabric where a first upper surface side warp weaves a first lower surface side weft at least once without weaving a first upper surface side weft and where a first lower surface side warp passes between the upper and lower layer fabrics without weaving the first lower side weft, wherein a second upper surface side warp weaves only the upper surface side wefts, wherein a second lower surface side warp weaves only the lower surface side wefts, and wherein the first upper surface side warp and the first lower surface side warp deviate from a weaving structure of the second upper surface side warp and the second lower surface side warp, respectively, at at least one spot where the upper layer fabric and the lower layer fabric are bound to each other.

12. An industrial two-layer fabric which comprises an upper layer fabric comprising upper surface side warps and upper surface side wefts and a lower layer fabric comprising lower surface side warps and lower surface side wefts, wherein the upper layer fabric and the lower layer fabric are bound to each other at at least one spot in a repeating unit of the two-layer fabric where a first upper surface side warp passes between the upper and lower layer fabrics without weaving a first upper side weft, and where a first lower surface side warp weaves the first upper surface side wefts without weaving a first lower surface side weft, wherein a second upper surface side warp weaves only the upper surface side wefts, wherein a second lower surface side warp weaves only the lower surface side wefts, and wherein the first upper surface side warp and the first lower surface side warp deviate from a weaving structure of the second upper surface side warp and the second lower surface side warp, respectively, at at least one spot where the upper layer fabric and thelower layer fabric are bound to each other.

13. The fabric according to claim 11 or 12, wherein a second lower surface side warp disposed adjacentto the first upper surface side warp lies under a lower surface side weft at a place adjacent to where the first upper side warp lies under the lower surface side weft.

* * * * *